United States Patent [19]

Leon

[11] 4,372,631

[45] Feb. 8, 1983

[54] FOLDABLE DRAFTING TABLE WITH DRAWERS

[76] Inventor: Harry I. Leon, 924 Bowen St., NW., Atlanta, Ga. 30318

[21] Appl. No.: 308,146

[22] Filed: Oct. 5, 1981

[51] Int. Cl.[3] ..... A47B 27/00; A47F 5/12

[52] U.S. Cl. ..... 312/231; 312/233; 108/6; 108/8

[58] Field of Search ..... 312/231, 333; 108/6, 108/8, 9, 26

[56] References Cited

U.S. PATENT DOCUMENTS

| | | | |
|---|---|---|---|
| 138,896 | 5/1873 | Keuffel et al. | 312/333 |
| 200,173 | 2/1878 | Closterman | 108/9 |
| 201,723 | 3/1878 | Wakefield | 108/8 |
| 874,846 | 12/1907 | Higgins | 108/6 |
| 1,477,409 | 12/1923 | Woolman | 312/231 |
| 1,525,877 | 2/1925 | Miller | 108/8 |
| 1,751,368 | 3/1930 | Swift | 312/231 |
| 1,838,558 | 12/1931 | Kolodny | 108/26 |
| 2,586,097 | 2/1952 | Scheu | 108/8 |
| 2,696,415 | 12/1954 | Himelson | 108/6 |
| 2,730,423 | 1/1956 | Mock | 312/333 |
| 2,808,308 | 10/1957 | Papelian et al. | 312/231 |
| 2,890,090 | 6/1959 | Olson | 312/333 |
| 3,119,356 | 1/1964 | Sauer | 108/8 |
| 3,495,552 | 2/1970 | Dietrick | 108/8 |
| 3,906,127 | 9/1975 | Hollmann et al. | 312/231 |
| 4,099,469 | 7/1978 | Sahli | 312/231 |
| 4,248,161 | 2/1981 | Adair et al. | 108/6 |

FOREIGN PATENT DOCUMENTS

| | | | |
|---|---|---|---|
| 273667 | 2/1951 | Switzerland | 108/26 |
| 1123146 | 8/1968 | United Kingdom | 108/6 |

*Primary Examiner*—Victor N. Sakron

*Attorney, Agent, or Firm*—V. L. Leon

[57] ABSTRACT

A lightweight drafting table having a full-size drafting board of sandwich-type construction, the underside of which is glued to a yoke having three support arms which are disposed approximately parallel to each other and which are connected to a cross member to form a rigid structure for supporting two drawers. The board provides the cover for the drawers when they are closed. Each drawer has a slot formed in each of two sides thereof; the walls of each slot ride on a key which protrudes laterally from one of the support arms. A slight drag between the key and the slot prevents each drawer from opening under the force of gravity alone when the drafting board and the drawer are tilted at an angle of several degrees to the horizontal and the drawer is fully loaded. The yoke is pinned to a pair of vertical support members attached to a four-legged base and to a pair of braces, each of which is also bolted to one of the support members to form a lightweight structure of exceptional strength. Several bolt holes are provided in each brace so that the angle of the board to the horizontal can be readily adjusted. With casters fitted to the base and the board folded nearly parallel to the vertical support members, the drafting table can be moved readily from one room to another by a single operator or stored in a small space.

9 Claims, 10 Drawing Figures

FOLDABLE DRAFTING TABLE WITH DRAWERS

BACKGROUND OF THE INVENTION

1. Field of the Invention

This invention relates to drafting tables of the type having a single pair of vertical support members about which the drafting board can be pivoted.

2. Description of the Prior Art

A drafting table in the prior art comprises a drafting board supported at an angle above a four-legged table or desk which has its own top in addition to the drafting board. Drawers for storing drafting supplies are either supported beneath the top of the four-legged table or are included in a separate piece of furniture. In the former arrangement, the drawers tend to obstruct the movement of the draftsperson's legs, especially when the draftsperson is sitting upon a drafting chair having an elevated seat. Placement of the drawers in a separate table or desk, on the other hand, consumes floor space. Moreover, mobility, which is restricted by the fact that the drafting table alone tends to be heavy and bulky in order to eliminate any relative movement between the drafting board and its support structure, is further hampered by the addition of yet another piece of furniture.

SUMMARY OF THE INVENTION

The principal object of the present invention is to improve the construction of drafting tables of the type discussed above by providing at least two support arms which are disposed approximately parallel to each other and which are attached to the underside of a light-weight drafting board of sandwich-type construction to form a rigid structure for supporting at least one drawer. The drafting board covers the drawer when it is closed, thus eliminating the need for a table top and providing ample clearance between the drawer and the floor for the movement of a draftsperson's legs. Moreover, with the drawer supported directly beneath the board, the drafting table can be folded rapidly into a unit of narrow width to facilitate its transport.

A key formed in each support arm is insertable into a slot formed in the contiguous side of the drawer, the drawer being slidable along the key. A slight drag between the key and the slot prevents the drawer from opening under the force of gravity alone when the drafting board and the drawer are tilted at an angle of several degrees to the horizontal and the drawer is fully loaded.

A further object is to provide a pair of light-weight, three-sided, pinned structures of exceptional strength for supporting a drafting board, each structure comprising a support arm, a vertical support member, and a brace. The pin connecting each support arm and vertical support member as well as the pin connecting each support arm and brace extend through openings formed in the key in the support arm and in the contiguous portion thereof. The heads of the pins are recessed beneath the surface of the key so that they do not interfere with the motion of the drawer along the key.

Molding which rises above the top surface of the drafting board a slight distance, which is approximately equal to the thickness of a vinyl cover sheet, is attached to the sides of the board to reduce the incidence with which the cover sheet becomes snagged by a drafting instrument and pulled away from the surface of the board.

Another object is to provide a drafting table which can be easily disassembled for shipment and reassembled thereafter, all of the various components of the drafting table being of such dimensions that they can be packaged together within a thin shipping container having a thickness of approximately 8 inches and a width and length slightly greater than the corresponding dimensions of the drafting board.

BRIEF DESCRIPTION OF THE DRAWINGS

Further details are explained below with the help of the examples illustrated in the attached drawings in which:

FIG. 9 is an enlarged bottom plan view taken on line IX—IX through the vertical support members in FIG. 1.

Like reference characters indicate corresponding parts throughout the several views of the drawings.

DESCRIPTION OF THE PREFERRED EMBODIMENT

Figure 1:
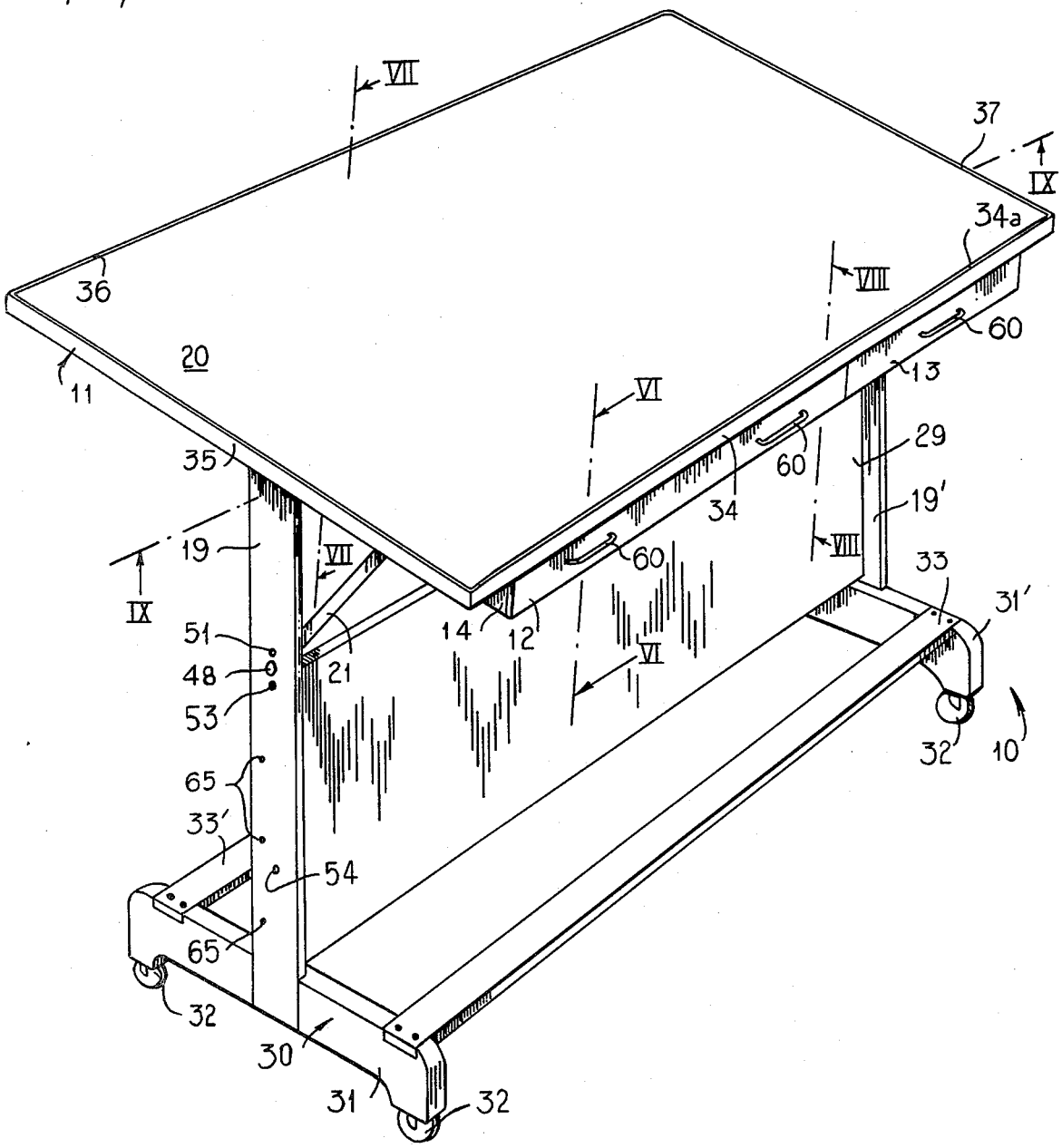
FIG. 1 is a perspective view of a drafting table according to the present invention when the drafting board is tilted at an angle of several degrees to the horizontal.

In the drawings, a drafting table 10 according to the present invention comprises a board 11 beneath which are suspended drawers 12 and 13 as described hereinbelow. The board 11, except those portions thereof which are in close proximity to its periphery, is preferably made of a lightweight material of sandwich-type construction having thin faces 41, 42 of hardwood separated by a core structure 43 formed of corrugated fiberboard or the like (FIGS. 4–7). The board 11 is preferably full-size, the dimensions thereof measuring, by way of example, approximately 36 inches by 60 inches.

A so-called hollow-core door may be utilized to form the board 11, the peripheral regions of the board 11 having solid wood blocks 61–63 which are inserted between the thin upper and lower faces 41 and 42 as illustrated in FIGS. 4–8. The wood block 61 is sufficiently wide to support such items as a drafting machine and a lamp (not shown) when they are clamped to the upper edge of the board 11. Alternately, the wood blocks 61–63 provide support for a drafting machine utilizing pulleys (not shown) which are secured to the underside of the board 11.

As is illustrated in FIGS. 1, 4–7, and 9, the periphery of the board 11 has four sections of molding 34–37 attached, preferably by glue, thereto. The molding is approximately ¼th inch thick, made of a hardwood such as sandalwood or the like, and is glued to the remainder of the board 11. The molding sections 34–37 provide wear resistance for the board 11. In addition, the molding sections 35–37 extend upwardly a distance of approximately 1/16th inch above the proximate upper surface of the board 11. The molding section 34 also extends upwardly but a greater distance so that a catcher 34*a*, as described hereinbelow, is formed.

Figure 4:
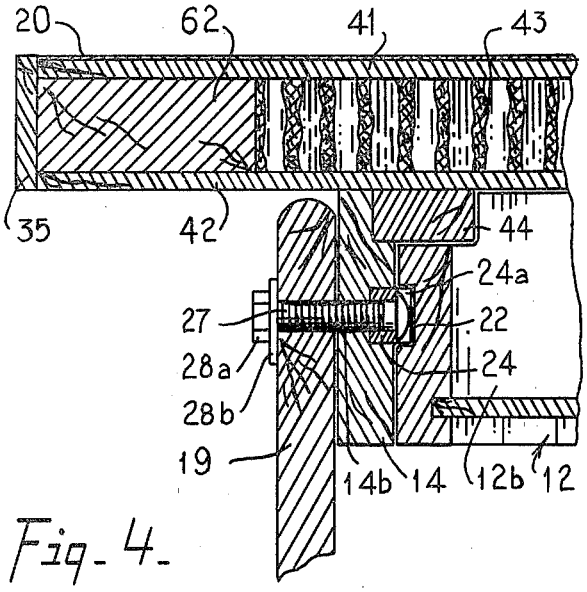
FIG. 4 is an enlarged fragmentary cross-sectional view taken on line IV—IV through the pivotal joint between the support arm and the vertical support member in FIG. 2.
Figure 5:
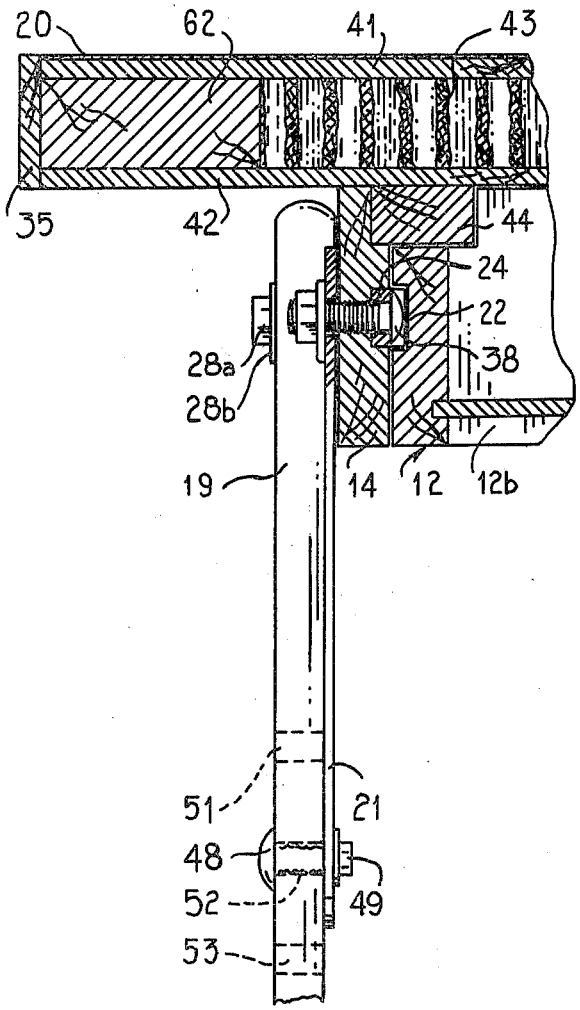
FIG. 5 is an enlarged fragmentary cross-sectional view taken on line V—V through the brace in FIG. 2.
Figure 7:
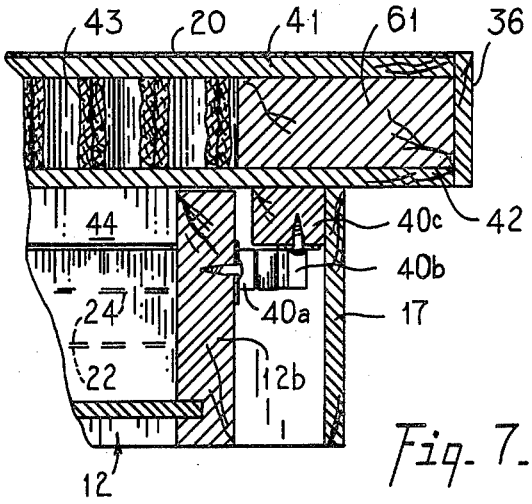
FIG. 7 is an enlarged fragmentary cross-sectional view taken on line VII—VII through the rear portion of a drawer and the drafting board in FIG. 1.

When placed atop the board 11 within the raised sides of the molding sections 34–37, the upper surface of a vinyl cover sheet 20 is flush with the upper surfaces of the sections 35–37 (FIGS. 4, 5, and 7). A router can be used to machine the sections 35–37 to create a smooth transition between them and the sheet 20. Such a transition between the upper surfaces of the molding sections 35–37 and the sheet 20 helps to eliminate the possibility that any one of its corners will become snagged by one of the drafting instruments and inadvertently lifted from the board 11 with a concomitant disruption of the draftsperson's work.

Figure 6:
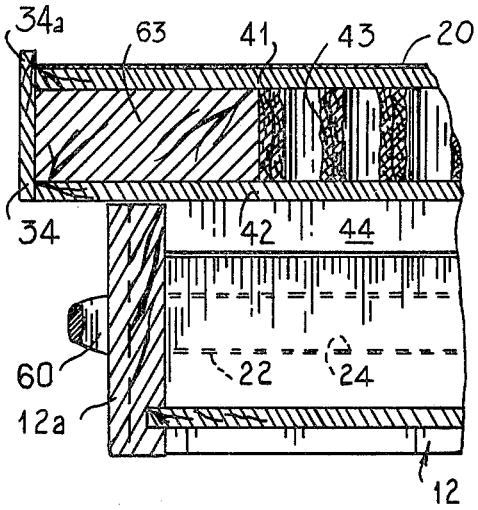
FIG. 6 is an enlarged fragmentary cross-sectional view taken on line VI—VI through the front portion of a drawer and the drafting board in FIG. 1.

In contrast, the molding section 34, secured to the front edge of the board 11, extends upwardly a distance substantially greater than the thickness of the vinyl cover sheet 20 for substantially the entire length thereof (FIGS. 1 and 6). The upwardly projecting catcher portion 34*a* of the molding section 34 comprises a means for catching drafting implements such as pencils, lead holders, and inking pens (not shown) which have a tendency to roll downwardly across the surface of the board 11 and which, in the absence of the catcher 34*a*, would fall from the board 11.

As is illustrated in FIGS. 4, 7–9, support arms 14–16 and a cross member 17 comprise a yoke 18 which is glued to the underside of the board 11. The cross member 17 is rigidly attached to one end of each of the support arms 14–16. The yoke 18 reinforces the board 11 and provides a structure to which a pair of vertical support members 19, 19' can be secured. The yoke also supports the drawers 12, 13 which are insertable into the openings formed between the leading edges 14*a* and 16*a*, 15*a* and 16*a*, respectively (FIG. 9).

The support arms 14–16 are braced laterally by reinforcing stays 44–46 (FIGS. 4, 5, 8, 9), each of the stays extending substantially the entire length of the support arm along which it is juxtaposed and to which it is secured by glue. The joint between each support arm and the contiguous reinforcing stay is strengthened by providing more than one plane within which each support arm and stay is affixed to each other, thereby increasing both the contact area of the joint as well as the magnitude of a shear force required to cleave it. Thus under normal use, shear forces applied to the joint will be dissipated through the support arm. As is illustrated in FIGS. 4, 5, and 8, the upper corners of the rear plates 12*b*, 13*b* of each drawer 12, 13 are cut away so that there is sufficient clearance between the plates 12*b*, 13*b* and the stays 44–46 for the drawers 12, 13 to be slid along the keys 24–26, 26' as described hereinbelow.

Figure 8:
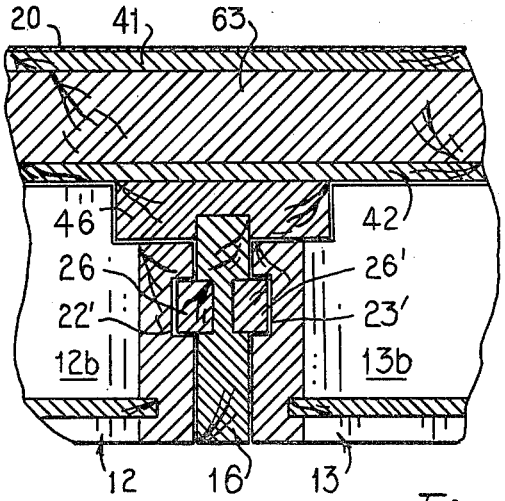
FIG. 8 is an enlarged fragmentary cross-sectional view taken on line VIII—VIII through a two-drawer support arm in FIG. 1.

As is best seen in FIGS. 4, 8, and 9, keys 24 and 26 protrude from opposing faces of the support arms 14 and 16 and are disposed generally parallel to each other so that the pair of slots 22 and 22' which are formed on the sides of the drawer 12 as described hereinbelow can be slidably engaged simultaneously with the keys 24 and 26, respectively. Likewise, the keys 25 and 26' protrude from the support arms 15 and 16, the two-drawer support arm 16 having two keys 26 and 26' which extend laterally from its sides to suspend a drawer on either side of it. The pair of slots 23 and 23', described hereinbelow, can be slidably engaged with the keys 25 and 26', respectively. As is illustrated in FIGS. 4, 5, 8, and 9, each key 24–26, 26' comprises a wood insert, a portion of which is fitted and glued within a groove formed in one of the support arms 14–16.

As is seen in FIGS. 4–9, each of the drawers 12, 13 has slots 22, 22' and 23, 23', respectively, formed in each of the two sides thereof. Each slot 22, 22' extends from the rear edge of the side in which it is formed to the joint between that side and front plate 12*a* of the drawer 12. Similarly, each slot 23, 23' extends substantially the length of the side in which it is formed, the slots 23, 23' terminating at the joint between that side and the front plate 13*a* of the drawer 13.

Figure 3:
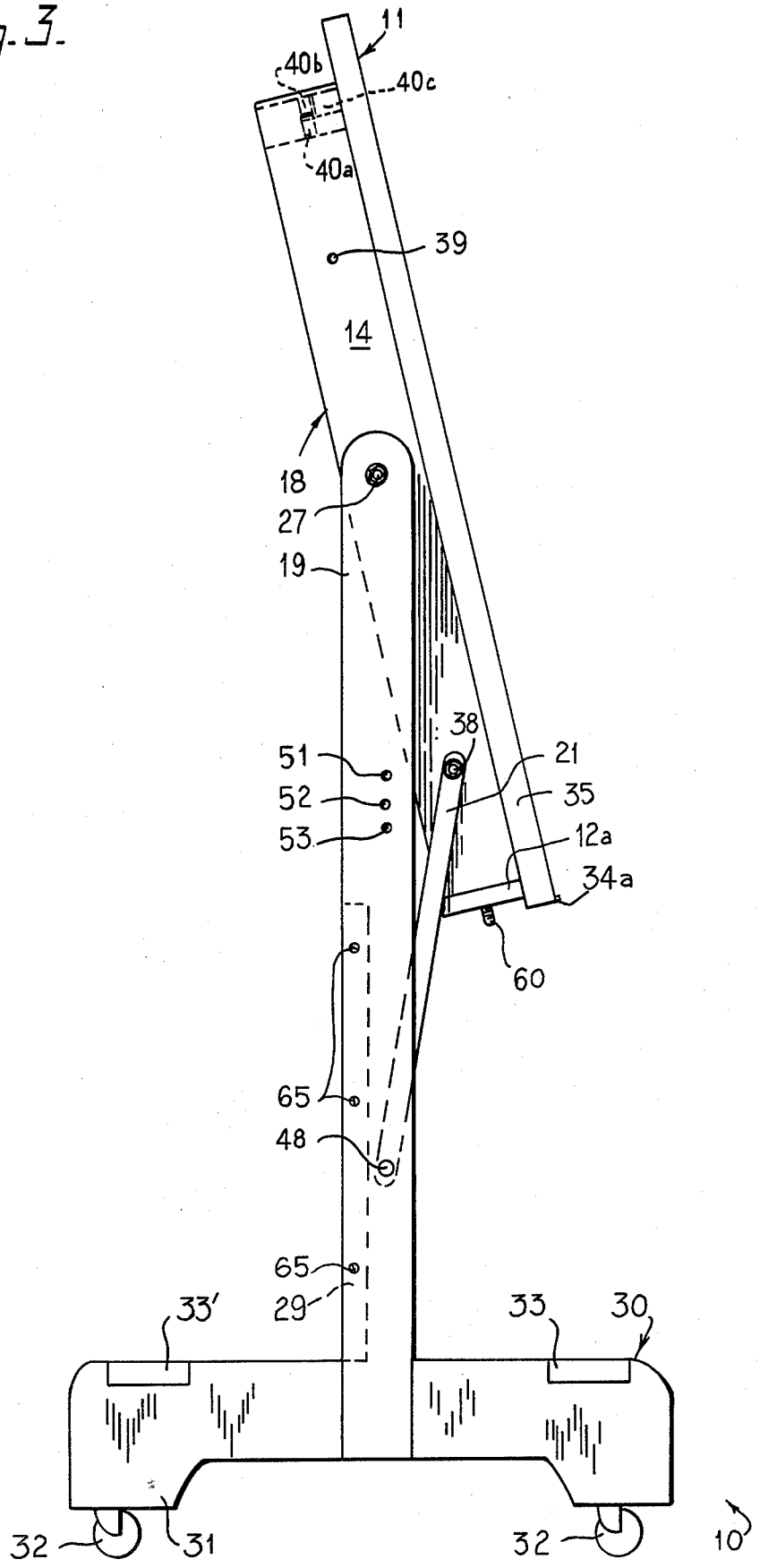
FIG. 3 is an enlarged side view of the drafting table according to FIG. 1 when the drafting board is tilted generally downwardly and the brace is secured in a position for transport.

A slight drag between each key and the slot with which it is engaged prevents either drawer from opening under the force of gravity alone when the drafting board 11 and the drawers 12, 13 are tilted at an angle of several degrees to the horizontal and the drawer is fully loaded. Drawer handles 60 may be provided to facilitate opening the drawers 12, 13 (FIGS. 1, 6). Pairs of cabinet door-type catches 40*a*, 40*b*, when interlocked, connect the rear plates 12*b*, 13*b* with the blocks 40*c*, 40*d* attached to the underside of the board 11 and are employed so that a fully-loaded drawer can be maintained in a closed position when it is tilted downwardly at a steep angle (FIG. 3). Alternately, the drawers 12, 13 may be maintained in a closed position by tilting them so that the leading edges thereof are positioned upwardly. The drafting table 10 can be folded rapidly into either position to form a unit of narrow width to facilitate its transport.

The drawers 12, 13 are preferably of differing sizes with the larger drawer 12 being used to store drawings and the smaller drawer 13 to store drafting instruments. Alternately, a yoke with only arms 14 and 15 to support a single drawer therebetween may be provided. In a further modification of the yoke, two inner support arms 16 may be provided between the outer support arms 14 and 15 so that three drawers may be supported beneath the board 11. In each of these modifications, the drafting board 11 covers each drawer when it is closed. In such a compact arrangement, the clearance between each drawer and the floor is ample for the movement of a draftperson's legs.

As is best seen in FIG. 1, a pair of vertical support members 19, 19' extend generally downwardly from the underside of the board 11. Each member 19, 19' is pivotally connected to one of the support arms 14, 15 by a pin such as a carriage bolt 27 and a nut 28*a* (FIGS. 1–4). The vertical support members 19, 19'; support arms 14, 15; and the washers 28*b* each have a hole formed therein for receiving the bolts 27. A recess 24*a*, 25*a* in each of the keys 24, 25 communicates with the holes 14*b* and 15*b*, respectively (FIGS. 4 and 9). By forming a recess in each of the keys 24, 25 rather than in the support arms 14, 15, there is still adequate material present so that a larger bolt 27 can be utilized than would otherwise be practicable. Thus a strong pivotal joint is provided for a lightweight yoke 18.

Figure 2:
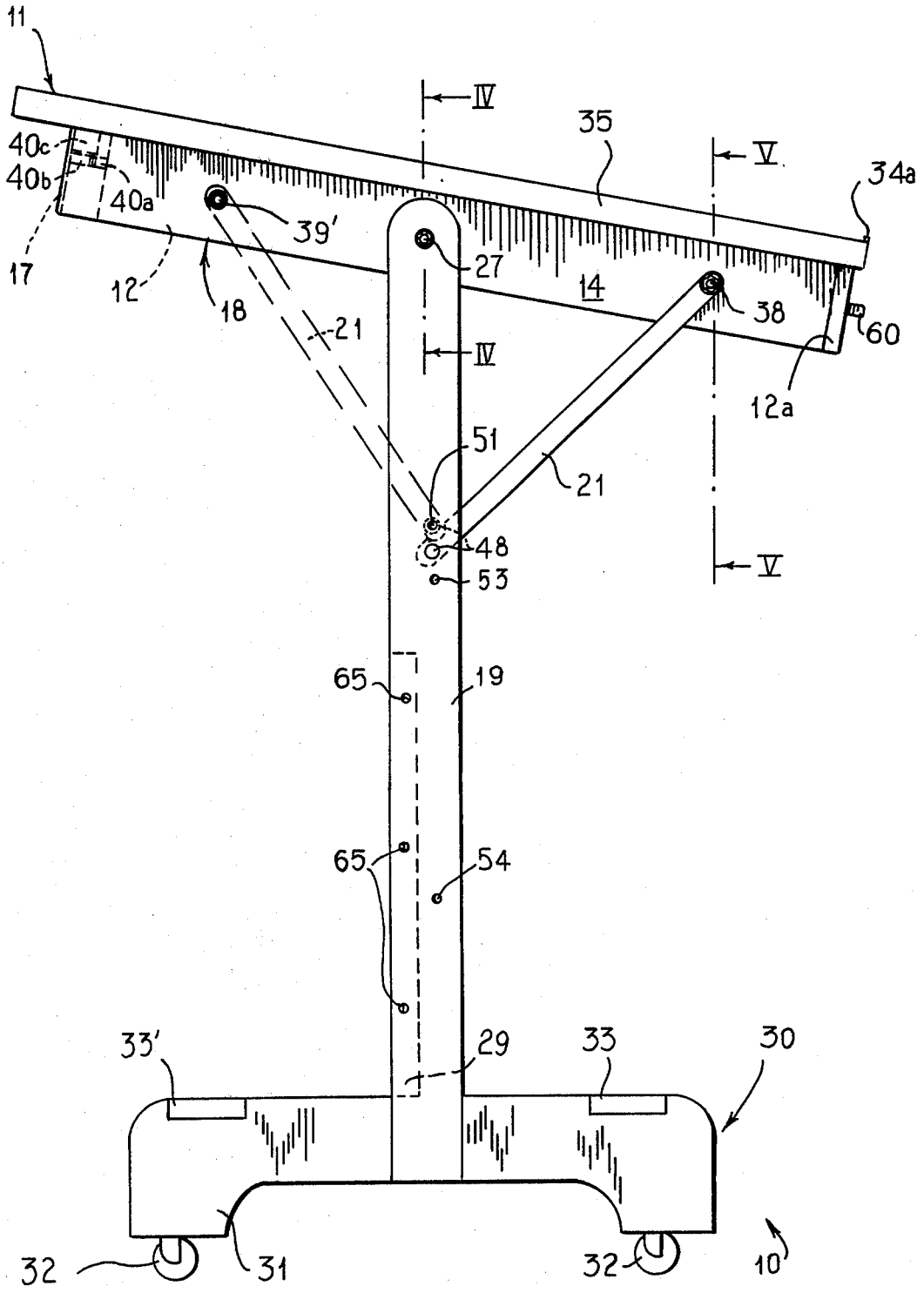
FIG. 2 is an enlarged side view of the drafting table according to FIG. 1; the dashed lines outline the position of the brace in an alternate embodiment of the present invention.

One end portion of the brace 21, which is preferably formed of steel, is also pinned to the support arm 14 (FIGS. 2 and 5). The head of the bolt 38, which secures the brace 21 to the arm 14, is recessed in the key 24 so that the bolt 38 does not interfere with the motion of the drawer 12. The other end portion of the brace 21 is secured to the vertical support member 19 by the bolt 48. The support arm 14, the vertical support member 19 and the brace 21, when connected by the bolts 38 and 48, comprise a three-sided, pinned structure of exceptional strength. A similar second three-sided, pinned structure is formed by the support arm 15, the vertical support member 19', and an additional brace 21. Together with the yoke 18, this pair of lightweight, three-sided, pinned structures forms a sturdy support for the board 11 and for the weight of the upper portion of a draftsperson's body when rested thereon. Moreover, because of the incorporation of such lightweight structures and of the inclusion of sandwich-type construction material in the board 11, the total weight of the drafting table 10 is much lighter than that of a conventional drafting table.

The angle of the board 11 to the horizontal can be adjusted by varying the placement of the bolt 48 and of the nut 49 threaded thereon. The bolt 48 can be inserted in any one of the four holes 51–54 which is formed within each of the vertical support members 19, 19'. The lowermost hole 54 is provided so that the board 11 can be secured in a generally downwardly position (FIG. 3). With the board 11 folded nearly parallel to the vertical support members 19, 19', the drafting table 10 can be moved readily from one room to another or stored in a small space.

It is also possible to pin one end of the brace 21 to the member 19 with the bolt 48 inserted into the hole 51 and to connect the other end of the brace 21 to the support arm 14 by a bolt 39' inserted into the hole 39; the position of the brace 21 in this alternate embodiment, in which the brace 21 is placed in tension rather than in compression, is illustrated by the dashed lines in FIG. 2.

As is best seen in FIG. 1, a pair of vertical support members 19, 19' extend generally downwardly from the underside of the board 11, the lower portion of each member 19, 19' being rigidly attached to a base 30 having feet 31, 31'. The joint between each of the members 19, 19' and the base 30 is a close-fitting one. The slot into which the lower portion of the vertical support member 19, 19' is inserted is preferably formed in the base 30 by dadoing to obtain the required close tolerance. It is also preferred that the lower portion of each vertical support member 19, 19' be secured to each foot 31, 31' by glue but screws may also be utilized.

Each foot 31, 31' rests upon a pair of casters 32. The feet 31, 31' also have notches formed therein into which a pair of foot rests 33, 33' can be inserted and secured to the feet 31, 31' by screws (FIG. 1). As is also illustrated in FIG. 1, a kickboard 29 is held in place between the vertical support members 19, 19' by removable fasteners such as the screws 65 or the like. The kickboard 29, which is similar in construction to the board 11, is preferably made of a lightweight material having thin outer and inner faces of 3-ply plywood, each face consisting of hardwood veneers approximately ⅛th inch thick; the faces are separated by a core in the form of a honeycomb made of corrugated fiberboard or the like.

Figure 10:
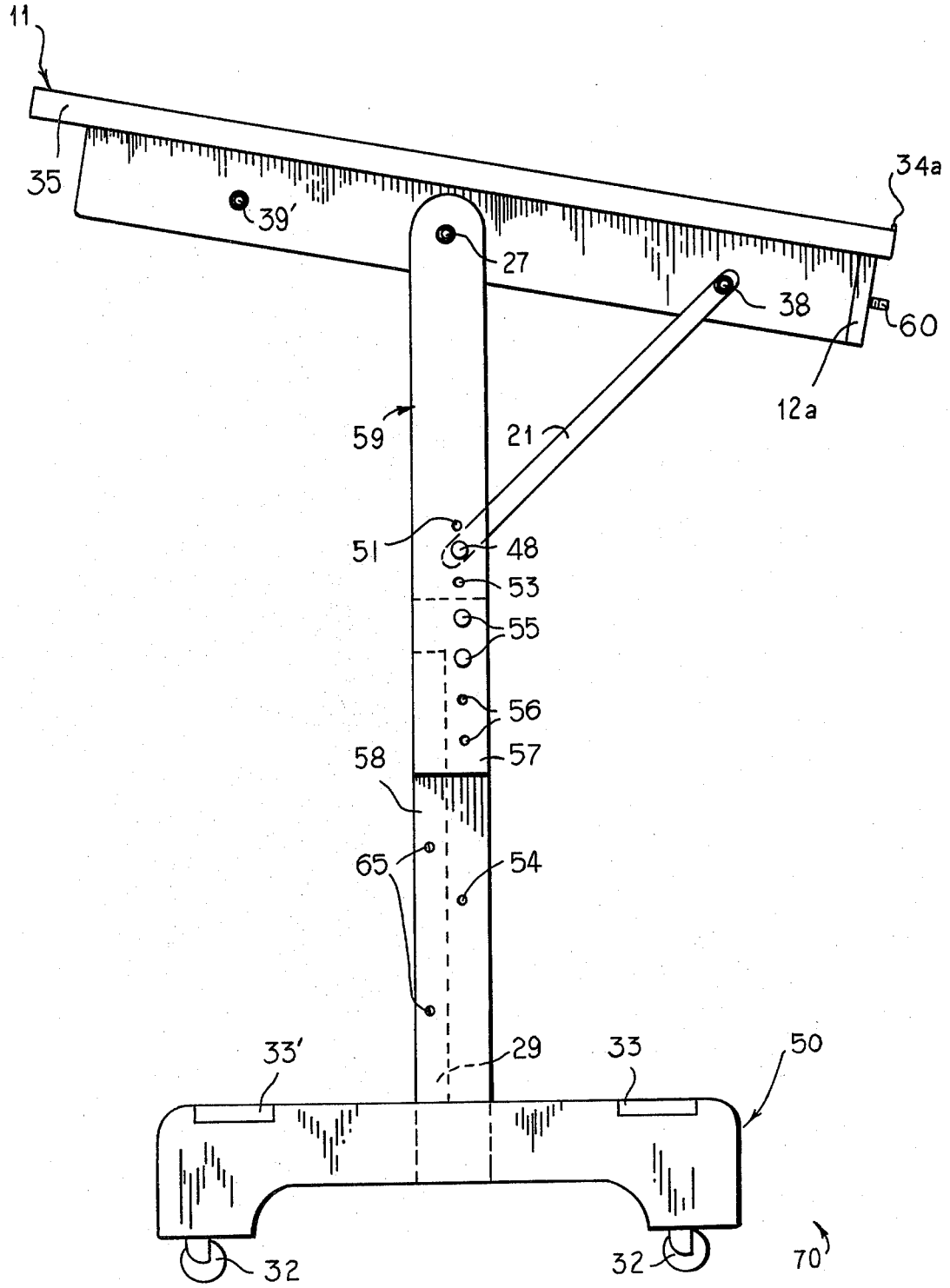
FIG. 10 is a perspective view of a further embodiment of the present invention in which the length of the vertical support members is adjustable.

In a further embodiment 70 illustrated in FIG. 10, each of the two sections 57 and 58 overlap each other and are fastened together by bolts 55 to form a first vertical support member 59. The member 59 and a second vertical support member (not shown) which, like the member 59, has two sections 57 and 58 which overlap each other and which are joined together by bolts 55 are employed to carry the weight of the board 11. A plurality of holes 56 are provided in each of the sections 57, 58; the average height of the board 11 above the floor can be adjusted by varying the placement of the pairs of bolts 55 connecting each pair of sections 57 and 58. The spacing between contiguous holes 56 in each of the sections 57, 58 is equal to facilitate the process of adjusting the height of the board 11. The two overlapping sections 57 and 58 secured by the bolts 55 inserted through the holes 56 comprise a means for adjusting the length of each of the vertical support members.

Although several embodiments of the invention have been illustrated in the accompanying drawings and described in the foregoing detailed description, it will be understood that the invention is not limited to the embodiments disclosed, but is capable of numerous rearrangements, modifications, and substitutions without departing from the scope of the invention.

What is claimed is:

1. A drafting table which comprises:

(a) a board;

(b) at least one pair of support arms which are attached to the underside of the board, the support arms being spaced apart from, and disposed generally parallel to, each other; and (c) a drawer which is insertable between the pair of support arms; each support arm having first slot and key means cooperating with second slot and key means on the drawer for supporting the drawer beneath the board, even when the drawer is tilted at an angle of several degrees from the horizontal, (d) said first slot and key means further comprises at least one pair of keys and a pair of stays, each stay protruding from one of the support arms on a side thereof to which one of the keys is connected; each stay and the key proximate thereto being spaced apart, the opposing walls thereof being disposed generally parallel to each other; and (e) said second slot and key means further comprises a pair of slots formed in the sides of each drawer and segments of the drawer disposed between each slot and the proximate upper edge of the drawer, each key cooperating with a slot as at least one of said segments cooperates with a pair of opposing walls, so that drag forces between a key and the slot with which it cooperates are augmented by interaction between a segment and at least one of the opposing walls proximate thereto, thereby braking movement of the drawer under the force of gravity alone.

2. A drafting table according to claim 1 which further comprises a pair of vertical support members, each of which is pivotally connected to a portion of a support arm reinforced by the key connected thereto, so that the drafting table can be folded into a unit of narrow width to facilitate its transport.

3. A drafting table which comprises:

(a) a board;

(b) a pair of support arms which are connected to the underside of the board, the support arms being spaced apart from, and disposed generally parallel to, each other; a pair of keys, each key being rigidly connected to one of the support arms; the lengths of each support arm and the key connected thereto being substantially equal; each key having at least two recesses formed therein, the section of the support arm which is contiguous to each recess having one hole which communicates therewith;

(c) a pair of vertical support members, each member being connected to one of the support arms near its mid-section;

(d) a pair of braces, one end of each brace being connected to one of the vertical support members, the other end of each brace being connected to one of the support arms; and (e) at least two pins, one of which connects each support arm to one of the vertical support members and the other of which connects each support arm to one of the braces, portions of each pin being disposed within one of the recesses and the hole proximate thereto, thereby forming a pair of three-sided structures for supporting the board.

4. A drafting table which comprises:

(a) a board;

(b) at least one pair of support arms which are connected to the underside of the board, the support arms being spaced apart from, and disposed generally parallel to, each other;

(c) a pair of vertical support members; at least one pin which connects each support arm to one of the vertical support members;

(d) at least one drawer which is insertable between the pair of support arms; each support arm having a key which cooperates with a slot on the drawer for supporting it beneath the board; and (e) the keys being disposed generally parallel to each other, each key having at least one recess formed therein, the recess being disposed substantially within a section of each key which protrudes from the support arm to which it is connected; the portion of the support arm which is contiguous to the key having a hole which communicates with the recess, the head of the pin being disposed entirely within the recess when the body of the pin is inserted into the hole, so that the pin does not interfere with the motion of the drawer along the way.

5. A drafting table according to claims 3 or 4 wherein the board is further characterized as having two thin faces of hardwood and a core structure of corrugated fiberboard, the faces being separated from each other by the core structure.

6. A drafting table according to claims 3 or 4 which further comprises:

(a) a cover sheet; and (b) a plurality of molding sections formed of a non-metallic material, one of which is secured to each of the narrow sides of the board, each molding section extending upwardly along substantially the entire length of the side of the board to which it is secured, the top surface of the molding section being disposed generally upwardly of the drafting board a distance which is at least as great as the thickness of the cover sheet, thereby substantially eliminating the snagging of the cover sheet by a drafting instrument.

7. A drafting table according to claims 1 or 4 which further comprises the drawer having means projecting from the rear side thereof for engaging a catch means secured to the board; the projecting means being releasable from the catch means when a force substantially in excess of gravity alone acting on the drawer is applied to the front thereof to pull it away from the catch means, so that the drawer can be maintained in a closed position when the board is tilted downwardly at a steep angle to the horizontal.

8. In an apparatus having a structure to which a pair of support arms are connected, the support arms being spaced apart from, and disposed generally parallel to, each other, the structure having at least one opening into which a drawer is insertable, the improvement comprising:

(a) at least one side of each support arm having a key and a stay protruding therefrom, the stay and the key proximate thereto being spaced apart, the opposing walls thereof being disposed generally parallel to each other; and (b) the drawer having a pair of slots formed in the sides thereof, each key cooperating with a slot; a segment of the drawer disposed between each slot and the proximate upper edge of the drawer cooperating with said opposing walls, the upper end of the segment riding against a stay as each key rides against a section of the sides of the slot with which it cooperates whenever the front of the drawer begins to rotate downwardly with respect to a plane which generally bisects the opening into upper and lower portions, thereby braking the movement of the drawer under the force of gravity alone.

9. An apparatus according to claim 8 which further comprises the drawer having means projecting from the rear side thereof for engaging a catch means connected to the structure; the projecting means being releasable from the catch means when a force substantially in excess of gravity alone acting on the drawer is applied to the front thereof to pull it away from the catch means.

* * * * *